US009988833B2

(12) United States Patent
Powell

(10) Patent No.: US 9,988,833 B2
(45) Date of Patent: Jun. 5, 2018

(54) STATIC HINGE DISABLER

(71) Applicant: Wasawegan Enterprises LLC, Ste. Genevieve, MO (US)

(72) Inventor: Michael A. Powell, Ste. Genevieve, MO (US)

(73) Assignee: Wasawegan Enterprises LLC, Ste. Genevieve, MO (US)

( * ) Notice: Subject to any disclaimer, the term of this patent is extended or adjusted under 35 U.S.C. 154(b) by 35 days.

(21) Appl. No.: 15/146,410

(22) Filed: May 4, 2016

(65) Prior Publication Data

US 2016/0326788 A1 Nov. 10, 2016

Related U.S. Application Data

(60) Provisional application No. 62/157,102, filed on May 5, 2015.

(51) Int. Cl.

| | |
|---|---|
| ***E05D 11/10*** | (2006.01) |
| ***E05D 3/02*** | (2006.01) |
| ***E05F 5/02*** | (2006.01) |

(52) U.S. Cl.

CPC ..... *E05D 11/1007* (2013.01); *E05D 3/02* (2013.01); *E05D 11/1014* (2013.01); *E05F 5/02* (2013.01); *E05Y 2201/22* (2013.01); *E05Y 2900/132* (2013.01)

(58) Field of Classification Search

CPC ... E05D 3/02; E05D 11/0018; E05D 11/0054; E05D 11/1007; E05D 11/1014; E05D 2011/0045; E05F 5/02; E05F 5/06

USPC ..... 16/82, 86 A, 86 R, 250–251, DIG. 17

See application file for complete search history.

(56) References Cited

U.S. PATENT DOCUMENTS

| | | | | | |
|---|---|---|---|---|---|
| 2,280,655 | A * | 4/1942 | Madsen | E05D 11/06 | 16/374 |
| 2,586,757 | A * | 2/1952 | Wummel | E05D 11/06 | 16/250 |
| 3,918,121 | A * | 11/1975 | Williams | E05D 11/1007 | 16/319 |
| 3,971,099 | A * | 7/1976 | Wallace | E05D 11/06 | 16/50 |
| 4,570,291 | A * | 2/1986 | Smith | E05D 11/0054 | 16/250 |
| 5,560,080 | A * | 10/1996 | Reed | E05D 11/0018 | 16/374 |
| 5,642,910 | A * | 7/1997 | Betherum | E05C 17/025 | 16/319 |
| 6,702,341 | B1 * | 3/2004 | Hudelson | E05D 11/0018 | 292/288 |
| 2002/0129464 | A1 * | 9/2002 | Davis | E05D 11/0054 | 16/250 |

(Continued)

*Primary Examiner* — Roberta S Delisle

(74) *Attorney, Agent, or Firm* — Erise IP, P.A.

(57) ABSTRACT

A static hinge disabler is provided for preventing the operation of a door hinge. The static hinge disabler includes a first sidewall, a second sidewall, a channel, and a cap. The first sidewall is substantially parallel to the second sidewall. The channel is disposed between the first sidewall and the second sidewall and configured to receive at least a portion of the door hinge therein. The first sidewall and the second sidewall are statically connected such that the channel does not change shape. The first sidewall and the second sidewall therefore prevent the door hinge from operating while the door hinge is disposed within the channel.

19 Claims, 7 Drawing Sheets

(56) References Cited

U.S. PATENT DOCUMENTS

2012/0186041 A1* 7/2012 Stots ..... E05D 11/1007
16/250
2013/0104344 A1* 5/2013 Lacy ..... E05D 5/14
16/374

* cited by examiner

STATIC HINGE DISABLER

RELATED APPLICATIONS

This non-provisional patent application claims priority benefit, with regard to all common subject matter, of earlier-filed U.S. Provisional Patent Application No. 62/157,102, filed on May 5, 2015, and entitled "UNITARY DOOR HINGE LOCK." The identified earlier-filed provisional patent application is hereby incorporated by reference in its entirety into the present application.

BACKGROUND

1. Field

Embodiments of the invention are broadly directed to door locks. More specifically, embodiments of the invention are directed to disabling a door hinge to prevent the door from opening.

2. Related Art

Door locks come in a wide variety of apparatuses. Most door locks operate on an engaging portion of the door instead of a hinged portion of the door. These door locks secure the door to an adjacent portion of a wall via a locking mechanism. These locks are typically permanently installed on or near the door, so as to allow a user to prevent the door from operating.

These door locks present several drawbacks. First, a malfeasant is often able to overcome the lock by applying a large force to the lock. Second, the malfeasant is often able to overcome the lock by 'picking' or otherwise maliciously disengaging the lock. Third, a child is often capable of disengaging the door lock to leave a residence without a guardian's knowledge. Fourth, door locks cannot be used until they are properly (and typically permanently) installed onto the door and/or the wall. Finally, these door locks of the prior art take time to secure and have moving components prone to failure.

SUMMARY

Embodiments of the invention solve the above-mentioned problems by providing a static hinge disabler. The static hinge disabler offers many advantageous over prior art door locks. First, the static hinge disabler is resistant to damage imparted on the door by being in a protected location away from an engaging portion of the door, i.e., a side of the door on which the doorknob is located. The static nature of the static hinge disabler also means there are no weak components that are prone to failure. Second, the static hinge disabler precludes any picking or disengagement from outside the door by moving the locking mechanism to a position in which it cannot be accessed by a malfeasant outside the door. Third, when emplaced over a top hinge of a door, the static hinge disabler is out of the reach of children to prevent undesirable operation of the door. Fourth, the static hinge disabler need not be permanently installed on the door such that it can be used on any of numerous different doors. Finally, the static hinge disabler is quick and simple to operate. A person need only slide the static hinge disabler over a door hinge to prevent that door from opening, which can save lives in a dangerous situation. The static hinge disabler includes no moving or operational components that can fail.

A first embodiment of the invention is broadly directed to a static hinge disabler for preventing the operation of a door hinge, comprising a first sidewall, a second sidewall, a channel, and a cap. The first sidewall is substantially parallel to the second sidewall. The channel is disposed between the first sidewall and the second sidewall and configured to receive at least a portion of the door hinge therein. The first sidewall and the second sidewall are statically connected such that the channel does not change shape. The first sidewall and the second sidewall therefore prevent the door hinge from operating while the door hinge is disposed within the channel. The cap is configured to keep the first sidewall and the second sidewall in contact with the door hinge. The channel presents a cap side that is proximate to the cap and an open side that is opposite the cap side. The channel is configured to receive the hinge from the open side.

A second embodiment of the invention is broadly directed to a method of preventing the operation of a door hinge, the method comprising the following steps: aligning an exposed segment of the door hinge with a channel of a static hinge disabler, wherein the channel is disposed between a first sidewall of the static hinge disabler and a second sidewall of the static hinge disabler; sliding the exposed segment of the door hinge into the channel such that the exposed segment of the door hinge is disposed between the first sidewall and the second sidewall; and resting a top end of the exposed segment of the door hinge against a cap of the static hinge disabler such that the exposed segment remains within said channel, wherein the relative location of the first sidewall and the second sidewall prevent the exposed portion of the door hinge from operating.

A third embodiment of the invention is broadly directed to a door hinge system configured to be installed on a door at a wall, the door hinge system comprising: a first hinge configured to be installed between the door and the wall; a second hinge configured to be installed between the door and the wall, wherein the first hinge and the second hinge are configured to support the door and allow the door to selectively open and close; and a static hinge disabler (as described above) configured to be selectively placed over the first hinge while the door is closed to prevent the first hinge from operating and allowing the door to open.

Additional embodiments of the invention may be directed to a set of static hinge disablers including a first static hinge disabler of a first size configured to interface with a first hinge and a second static hinge disabler of a second size configured to interface with a second hinge, wherein the first hinge is of a size different than the size of the second hinge. Still other embodiments of the invention may be directed to a set of static hinge disablers of various sizes, so as to accommodate a wide variety of door hinge sizes.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1A:
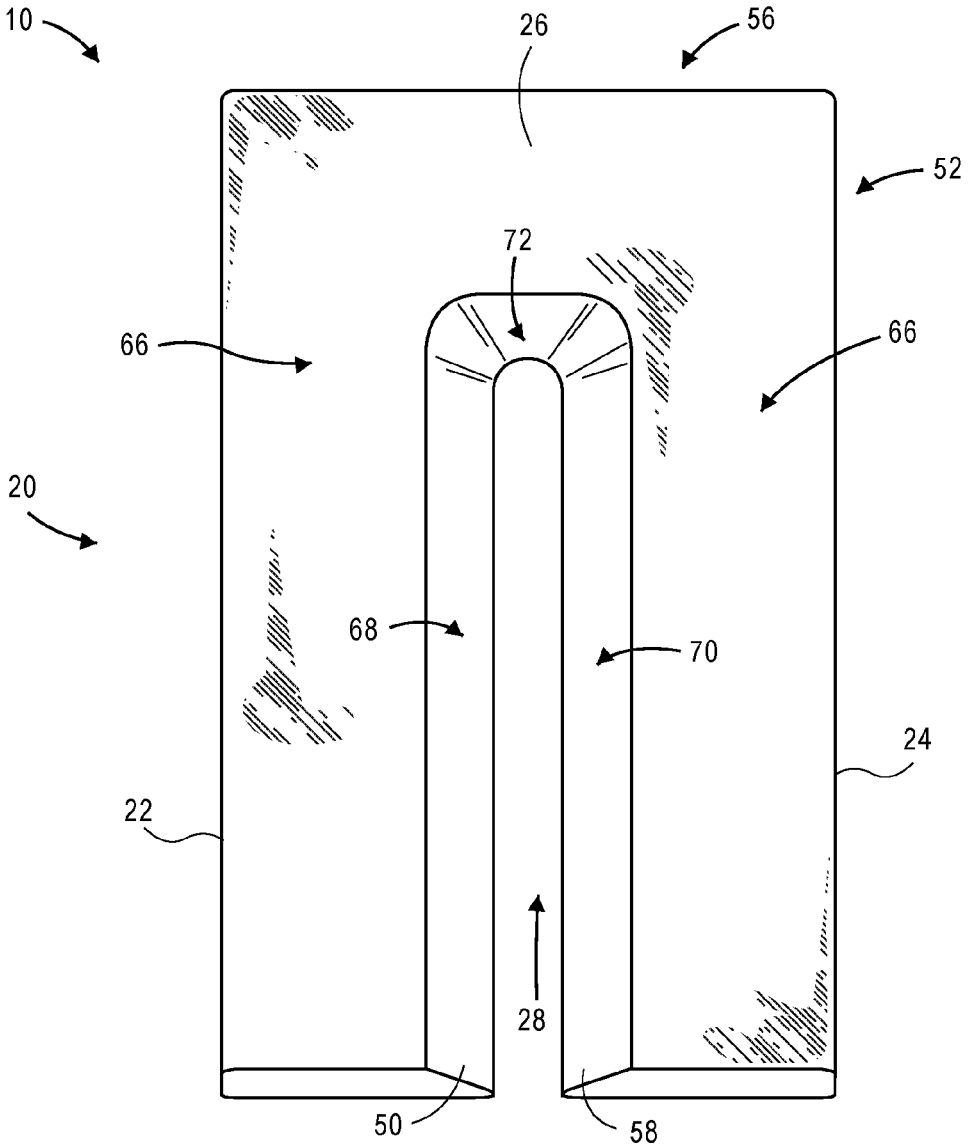
FIG. 1A is a perspective view of an open hinge configuration of a static hinge disabler.

The drawing figures do not limit embodiments the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 6:
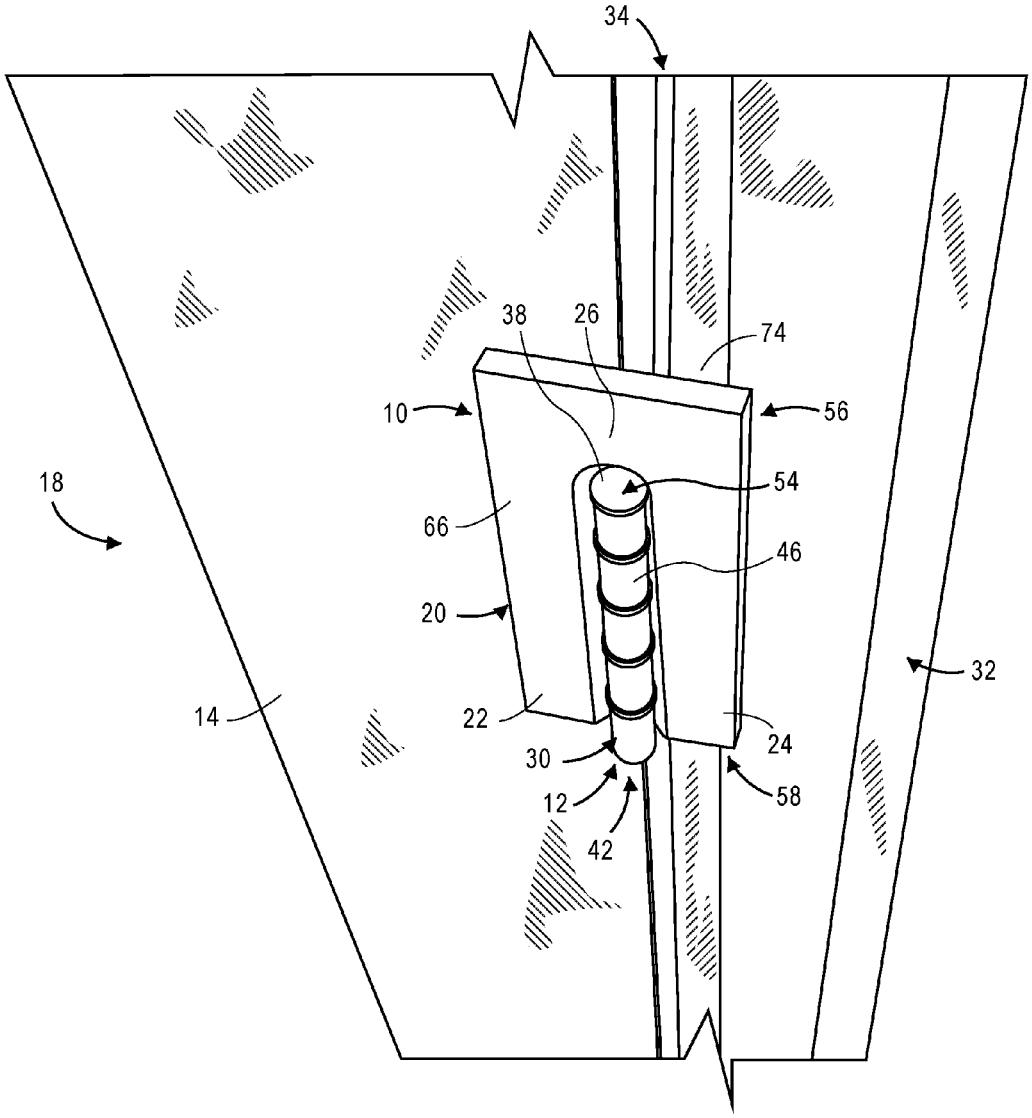
FIG. 6 is a perspective view of the static hinge disabler of FIG. 1A emplaced on a door hinge.
Figure 7:
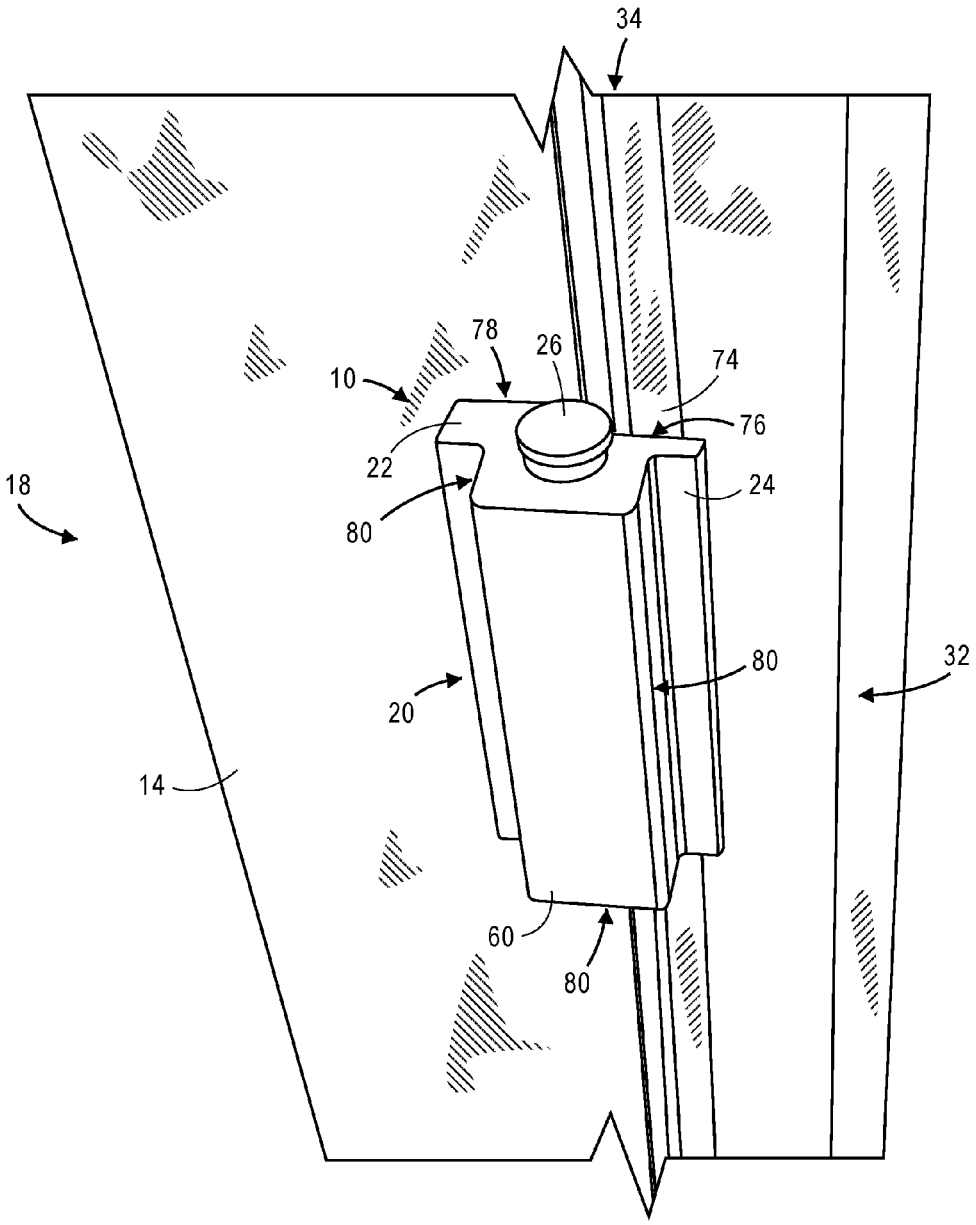
FIG. 7 is a perspective view of the static hinge disabler of FIG. 2A emplaced on a door hinge.

Turning to the figures, a static hinge disabler 10 of embodiments of the invention is configured to prevent operation of a door hinge 12. Examples of static hinge disablers 10 can be seen in FIGS. 1A, 2A, 3A, 4A, and 5A. Typically, the static hinge disabler 10 is utilized to prevent a door 14 from opening from an exterior side 16, such as by a malfeasant, or from an interior side 18, such as by a child (being incapable of reaching the static hinge disabler 10). The static hinge disabler 10 typically comprises an elongated body 20 that includes a first sidewall 22 and a second sidewall 24, as well as a cap 26. The static hinge disabler 10 presents a channel 28 that is configured to receive an exposed segment 30 of the door hinge 12, which is securing the door 14 to a wall 32. Examples of static hinge disablers 10 emplaced over the door hinge 12 are illustrated in FIGS. 6 and 7.

Before discussing the detailed components and variations of embodiments of the static hinge disabler 10, exemplary uses of the static hinge disabler 10 will now briefly be discussed to orient the reader as to certain potential uses for embodiments of the invention. It should be noted that these uses are only exemplary and that embodiments of the invention may be configured for other uses. Generally, the uses described below can be characterized as preventing the ingress of a malfeasant or preventing egress of a child or other persons incapable of removing the static hinge disabler 10.

Some embodiments of the invention are configured to counter active shooter scenarios. Active shooter scenarios are significant threats to schools and businesses. Preventing the active shooter from accessing classrooms and other areas is an important consideration in reducing casualties. Interior doors often do not include a door lock, or include a relatively weak door lock that can be easily overcome by the active shooter. Upon learning of an active shooter scenario in the school, a teacher or student can quickly and easily emplace the static hinge disabler 10 over a door hinge 12 of the classroom. The static hinge disabler 10 may be stored in a desk of the teacher, next to the door 14, or in another location that is quick and easy to access. The static hinge disabler 10 is also quick and easy to implement. There is little need for instructions or training on how to use the static hinge disabler 10. The provision of a static hinge disabler 10 can therefore potentially prevent the active shooter from entering the classroom.

As another example to which certain embodiments of the invention are directed is individual traveling. Hotels can provide additional safety for their patrons and employees by the provision of the static hinge disabler 10. The static hinge disabler 10 provides an extra, optional layer of protection from forceful entries. The hotel may therefore provide static hinge disablers 10 to their clients upon request or automatically for their added protection. As yet another example, frequent travelers who may feel that traditional door locks of hotel rooms provide inadequate protection can provide a further and greater level of protection by emplacing a static hinge disabler 10. As discussed below, the static hinge disabler 10 may be provided in a kit or carrying case such that the individual can bring the static hinge disabler 10 to the hotel.

As yet a further example to which embodiments of the invention are directed is home child-proofing. It is common for small children to leave their home or other location unexpectedly after learning how to operate the door 14. This can be potentially dangerous for the child, as the child could potentially could become lost, kidnapped, or injured if outside their home unsupervised. Traditional door locks are located proximate to the door handle and as such can be easily manipulated by the child. Parents and guardians therefore have no current option to prevent their child from leaving the house, other than to listen carefully for the door 14 to open. Parents and guardians of toddlers and other small children can prevent their children from leaving the house by use of the static hinge disabler 10, even if the child is able to operate a traditional door lock. This also allows parents and guardians to prevent their child from leaving other locations that don't have a door lock already installed.

Figure 8:
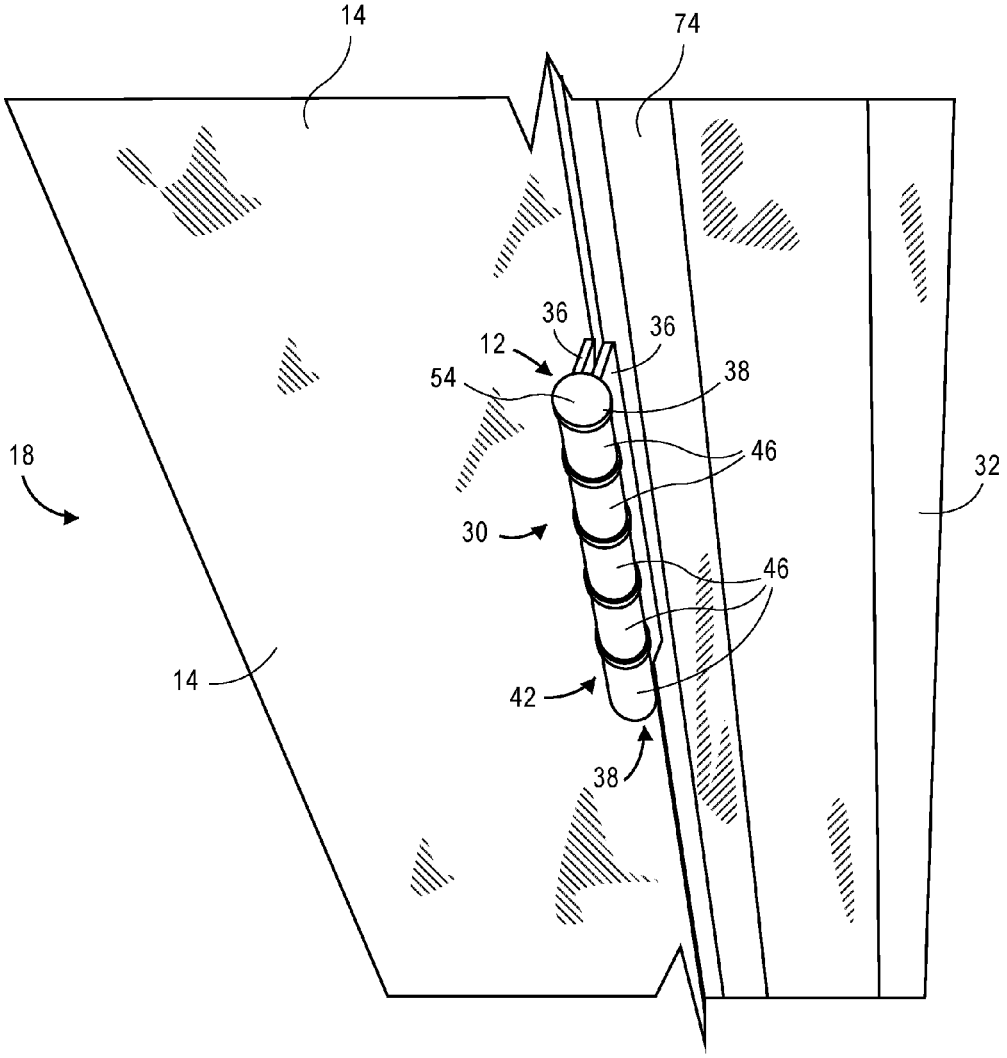
FIG. 8 is a perspective view of the door hinge of FIG. 6 and FIG. 7 with no static hinge disabler installed thereon, illustrating an exposed segment of the hinge between a door and a wall.
Figure 9:
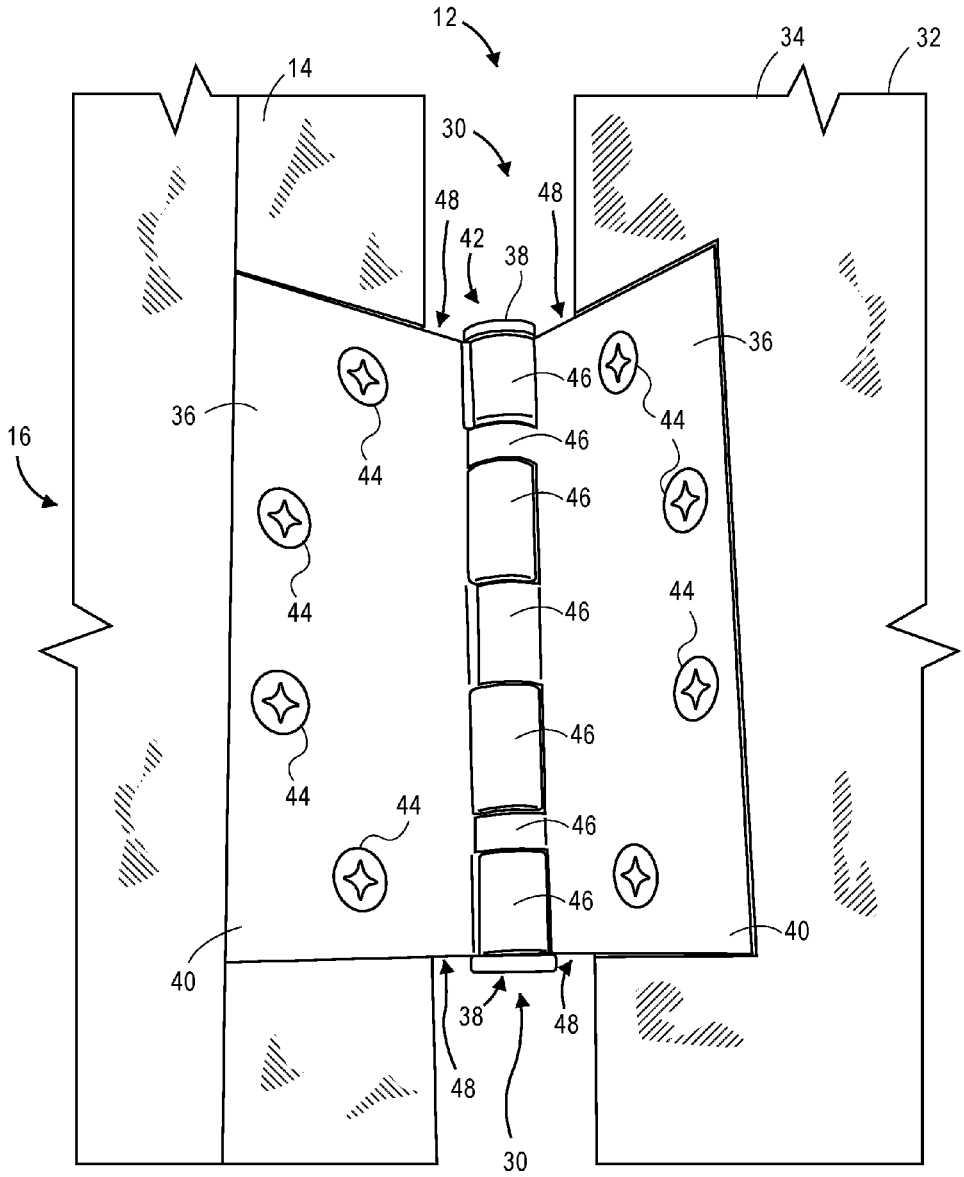
FIG. 9 is a perspective view of a door hinge of FIG. 8 in an open position, showing a door plate and a wall plate.

Because the static hinge disabler 10 is adapted to be emplaced over, and fit to, a standard door hinge 12, the structure of a standard door hinge 12 will be briefly discussed. A typical example of a door hinge 12 is illustrated in FIG. 8 and FIG. 9. FIG. 8 illustrates an exposed segment 30 of the door hinge 12, as viewed from the door hinge 12 being in a closed position. FIG. 9 illustrates a recessed segment of the door hinge 12 (as well as the exposed segment 30), as viewed from the door hinge 12 being in an open position. It should be noted that these illustrations show a typical door hinge 12, but embodiments of the invention may be configured to fit onto other door hinges 12, or other hinges that secure other objects (other than a door 14 to a wall 32).

Door hinges 12 pivotably connect the door 14 to a doorframe 34, which is a component of the wall 32. Typically, two or more door hinges 12 are emplaced on each door 14. The door hinge 12 comprises two plates 36 and a pin 38. Each plate comprises a fastener-receiving segment 40 and a hinging segment 42. The fastener-receiving segment 40 is generally flat and has openings for the receipt of fasteners 44 to secure the plate to the door 14 or the doorframe 34. The hinging segment 42 of the plate presents a plurality of annular segments 46 secured to the fastener-receiving segment 40.

As illustrated in FIG. 8, an extended portion 48 of the fastener-receiving segment 40 extends laterally beyond the door 14 or door hinge 12. The annular segments 46 are secured to the extended portion 48. The annular segments 46 of the two plates 36 fit together to present a cylindrical hinge with a channel 28 for receipt of the pin 38. The pin 38 is emplaced in the channel 28 to allow the plates 36 to pivot relative to each other. When both plates 36 are secured to the door 14 and the doorframe 34, respectively, the door 14 pivots from a closed position (in which the door 14 is substantially parallel and coplanar with the wall 32 around the doorframe 34) and an open position (in which the door 14 is ajar, i.e. not substantially parallel and coplanar with the wall 32), as illustrated in FIGS. 8 and 9, respectively. When in the closed position, the only exposed segment 30 of the door hinge 12 is the extended portion 48 of the fastener-receiving portion of the plate, the annular portions forming the cylindrical hinge, and the pin 38 (known collectively as the exposed segment 30). The exposed segment 30 is at least partially surrounded, covered, encased, and enclosed by the static hinge disabler 10.

The structure of the static hinge disabler 10 will now be discussed in detail. The static hinge disabler 10 presents a generally elongated shape, typically as long or slightly longer than the door hinge 12. The static hinge disabler 10 presents the channel 28 that has an interior shape that is complementary to at least a portion of an exterior shape presented by the exposed segment 30 of the door hinge 12. In embodiments of the invention, the static hinge disabler 10 is formed of a single, monolithic structure.

The static hinge disabler 10 broadly comprises the elongated body 20 and the cap 26. The elongated body 20 also presents the channel 28 (or a gap, void, or slit) in at least a portion of the elongated body 20. The interior shape of the channel 28 is complementary to, and substantially the same as or slightly larger than, an exterior shape presented by at least a portion of the exposed segment 30 of the door hinge 12. The exterior shape of the door hinge 12 is formed by the pin 38, the annular portions, and the extended portion 48 of the fastener-receptor segments of the plates 36 (as discussed above).

The elongated body 20 comprises the first sidewall 22 and the second sidewall 24. The first sidewall 22 is substantially parallel to the first sidewall 22. The first sidewall 22 is configured to be disposed adjacent to one of the plates 36 of the door hinge 12, and the second sidewall 24 is configured to be disposed adjacent to the other of the plates 36 of the door hinge 12. The first sidewall 22 is secured to the second sidewall 24, such that the first sidewall 22 and the second sidewall 24 are static. The first sidewall 22 may be secured to the second sidewall 24 in any of various methods described below. The first sidewall 22 and the second sidewall 24 do not move relative to one another, but are fixed. The first sidewall 22 and the second sidewall 24 prevent the door hinge 12 from operating while the door hinge 12 is disposed within the channel 28. The first sidewall 22 and the second sidewall 24 are therefore hardened and/or structurally reinforced to prevent the first sidewall 22 and the second sidewall 24 from becoming displaced relative to one another.

Figure 1B:
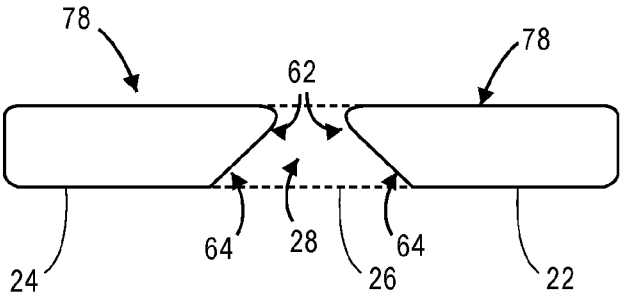
FIG. 1B is a bottom view of the static hinge disabler of FIG. 1A.

In some embodiments, such as illustrated in FIGS. 2B, 3B, 4B, and 5B, the first sidewall 22 and the second sidewall 24 present interior surface 50 that are generally parallel to one another. This allows the two plates 36 of the securely fit therebetween. In other embodiments, such as illustrated in FIG. 1B, the first sidewall 22 and the second sidewall 24 present interior surface 50 are oblique to one another. This allows the annular segments 46 of the and/or the two plates 36 to fit securely therebetween. In still other embodiments, the first sidewall 22 and the second sidewall 24 may present interior surface 50 of another shape, such as a combination of parallel and oblique. As another example, the first sidewall 22 and/or the second sidewall 24 may be arcuate or rounded. This may allow the static hinge disabler 10 to be installed on a wider variety of hinges because the arcuate shape may prevent the first sidewall 22 and the second sidewall 24 from being obstructed while being emplaced over the door hinge 12. This may also prevent damage to the door hinge 12 caused by the static hinge disabler 10.

Figure 5A:
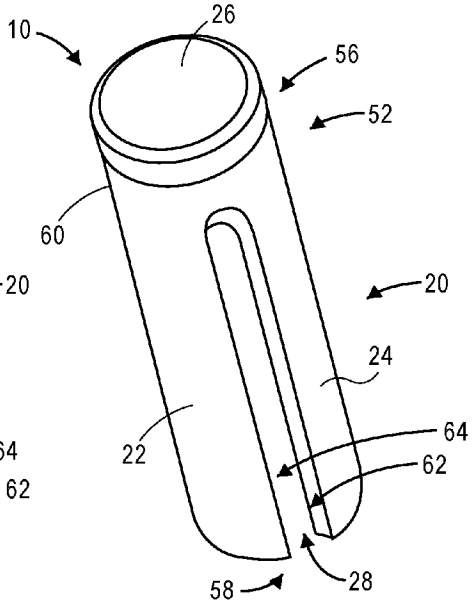
FIG. 5A is a perspective view of a rounded closed hinge configuration of a static hinge disabler.

As illustrated in FIG. 1A-5A, the cap 26 is disposed at a top end 52 of the elongated body 20 to provide a termination to the channel 28. The cap 26 therefore prevents the static hinge disabler 10 from falling while emplaced over the door hinge 12. The cap 26 keeps the first sidewall 22 and the second sidewall 24 in contact with the door hinge 12. The cap 26 also ensures that the maximum vertical length of the static hinge disabler 10 is in contact with the door hinge 12. This provides maximum strength between the first sidewall 22 and the second sidewall 24 to prevent displacement and failure. As best illustrated in FIG. 5A, the cap 26 may present an arcuate or rounded transition between a top of the cap 26 and a side of the cap 26.

The cap 26 is configured to rest against a top portion 54 of the door hinge 12 while the door hinge 12 is disposed within the channel 28. The channel 28 presents a cap side 56 that is proximate to the cap 26 and an open side 58 that is opposite the cap side 56. The cap side 56 is configured to receive and hold the door hinge 12 therein. The channel 28 is configured to receive the door hinge 12 from the open side 58.

In embodiments of the invention, the cap 26 is permanently secured to the elongated body 20. This may be for ease of manufacture, as the elongated body 20 typically includes a shape that is easy to machine without the cap 26 therein. An example of the cap 26 being permanently secured atop the elongated body 20 can be seen in FIGS. 2A, 3A, 4A, and 5A. The cap 26 may be secured by welding, a chemical adhesive, mechanical fasteners, or by other common securing methods.

In other embodiments, the cap 26 is unitary with the elongated body 20. The cap 26 may be originally formed with the elongated body 20. For example, the cap 26 and the elongated body 20 may be machined out of a single unit of metal, or the cap 26 and the elongated body 20 may be cast in a single casting of hardened plastic. An example of the cap 26 being unitary is illustrated in FIG. 1A. However, other figures such as FIG. 5A could be easily formed with a unitary cap 26, based upon the method of manufacturing the elongated body 20.

The static hinge disabler 10 can be formed in any of numerous different shapes. Five example shapes are illustrated in FIGS. 1A, 2A, 3A, 4A, and 5A. It should be appreciated that these shapes are only exemplary and other similar shapes could be utilized to form the static hinge disabler 10. These various shapes of the static hinge disabler 10 can be configured in any of numerous shapes about a horizontal cross-section. Five exemplary cross-sectional shapes are shown in FIGS. 1B, 2B, 3B, 4B, and 5B. Each of these five exemplary shapes will now be discussed individually to give the reader an appreciation for different ways in which the static hinge disabler 10 can be created.

Some embodiments of the invention can be classified as "open hinge" configurations, such as illustrated in FIG. 1A. Open hinge configurations expose the door hinge 12 when the static hinge disabler 10 is emplaced thereon. FIG. 6 shows an example of the static hinge disabler 10 of FIG. 1A installed on the door hinge 12 as illustrated in FIG. 8. As can be seen, the open hinge leaves the annular portion of the door hinge 12 exposed. Open hinge configurations may have an advantage of adaptability. As the entirety of the door hinge 12 does not have to be enclosed within the static hinge disabler 10, the static hinge disabler 10 may be able to fit on a wider variety of door hinges 12. Another possible advantage of some open hinge configurations is storage size. Open hinge configurations may take up less space and thus be easier for travel and transportation (such as in the exemplary hotel context described above). Open hinge configurations may have a disadvantage of structural strength, depending on the material of manufacture (as discussed below), the open hinge configuration may buckle upon a strong opening force.

Other embodiments of the invention can be classified as "closed hinge" configurations, such as illustrated in FIGS. 2A, 3A, 4A, and 5A. Closed hinge configurations encase the exposed segment 30 of the door hinge 12 therein. In embodiments of the invention, the static hinge disabler 10 further comprises a hinge case 60. FIGS. 2A-5A include a hinge case 60 secured to the first sidewall 22 and the second sidewall 24. The hinge case 60 is configured to surround the door hinge 12 that is disposed within the channel 28. In embodiments of the invention, the hinge case 60, the first sidewall 22, and the second sidewall 24 are all monolithic. In embodiments of the invention, the hinge case 60, the first sidewall 22, and the second sidewall 24 are permanently secured so as to prevent relative movement between the hinge case 60, the first sidewall 22, and the second sidewall 24.

In embodiments of the invention that include the hinge case 60, the channel 28 will typically include a plate-receiving segment 62 and an annular-receiving segment 64. The plate-receiving segment 62 (which is also present in open hinge configurations) is configured to be disposed adjacent to the two plates 36 of the door hinge 12. The annular-receiving segment 64 is configured to be disposed adjacent to the annular segments 46 of the door hinge 12. The combination of the annular-receiving segment 64 and the plate-receiving segment 62 therefore form a general rounded mushroom shape as viewed from the bottom or about a horizontal cross-section, as can be seen in FIGS. 2B, 3B, 4B, and 5B.

One embodiment of the invention is illustrated in FIG. 1A. FIG. 1A illustrates an embodiment of the invention in which the static hinge disabler 10 is generally flattened. The first sidewall 22, the second sidewall 24, and the cap 26 form a generally flattened plate 66 when viewed from the cap side 56. In addition to the channel 28 securing the door hinge 12, the first sidewall 22 and the second sidewall 24 are generally elongated so as to prevent operation of the door hinge 12 by preventing the opening of the door 14 from an outer edge of the first sidewall 22 and the second sidewall 24.

The channel 28 is disposed between the first sidewall 22 and the second sidewall 24, as discussed above. In this embodiment, the channel 28 is an open hinge configuration, such that a portion of the door hinge 12 passes through the channel 28, but is not encased by the channel 28. To form this embodiment, the channel 28 may be cut from a single plate of base material, such as steel or aluminum. This make the manufacture of the static hinge disabler 10 easy and efficient.

In embodiments of the invention, first sidewall 22 presents a first beveled edge 68, the second sidewall 24 presents a second beveled edge 70, and the cap 26 presents a third beveled edge 72. The beveled edge is configured to interface with the annular segments 46 of the door hinge 12. The beveled edge is also configured to interface with the two plates 36 of the door hinge 12. Based upon the presence of a door casing 74 or a non-flush door arrangement, the static hinge disabler 10 may not lay flush and parallel against the door 14 and the wall 32. The beveled edge therefore allows the static hinge disabler 10 to nonetheless fit onto the door hinge 12 and the door 14. In some embodiments, the first beveled edge 68, the second beveled edge 70, and the third beveled edge 72 are continuous. In some embodiments, there is no third beveled edge 72 on the cap 26.

FIG. 6 illustrates an embodiment of the invention of FIG. 1A being emplaced on the door hinge 12. As can be seen, the annular segments 46 of the door hinge 12 are exposed beyond the static hinge disabler 10. This allows the static hinge disabler 10 to fit over the annular segments 46 regardless of their size. As can also be seen, the first sidewall 22 and the second sidewall 24 are disposed along the door 14 and the wall 32. This prevents excessive movement of the door 14 relative to the wall 32. This assists the channel 28 in preventing undesired operation of the door 14.

In other embodiments of the invention, the static hinge disabler 10 of FIG. 1A may include a protrusion (not illustrated). The protrusion is configured to receive a hand or other object to assist in removing the static hinge disabler 10 from the door hinge 12. The protrusion may protrude laterally away from the wall 32 and/or the door 14. The protrusion may extend from the cap side 56 of the static hinge disabler 10, from the cap 26, or from another component. This allows the static hinge disabler 10 to be easily pushed upward. This may be helpful in that open hinge configurations may be difficult to grip and the static hinge disabler may become wedged or tightly pressed against the door 32 and/or the wall 14 (especially following an attempted opening of the door while the static hinge disabler is emplaced over the hinge). The protrusion therefore provides an easy grip. In some embodiments, the protrusion may be triangular, rectangular, arcuate, or another shape configured to be gripped or pushed.

Figure 2A:
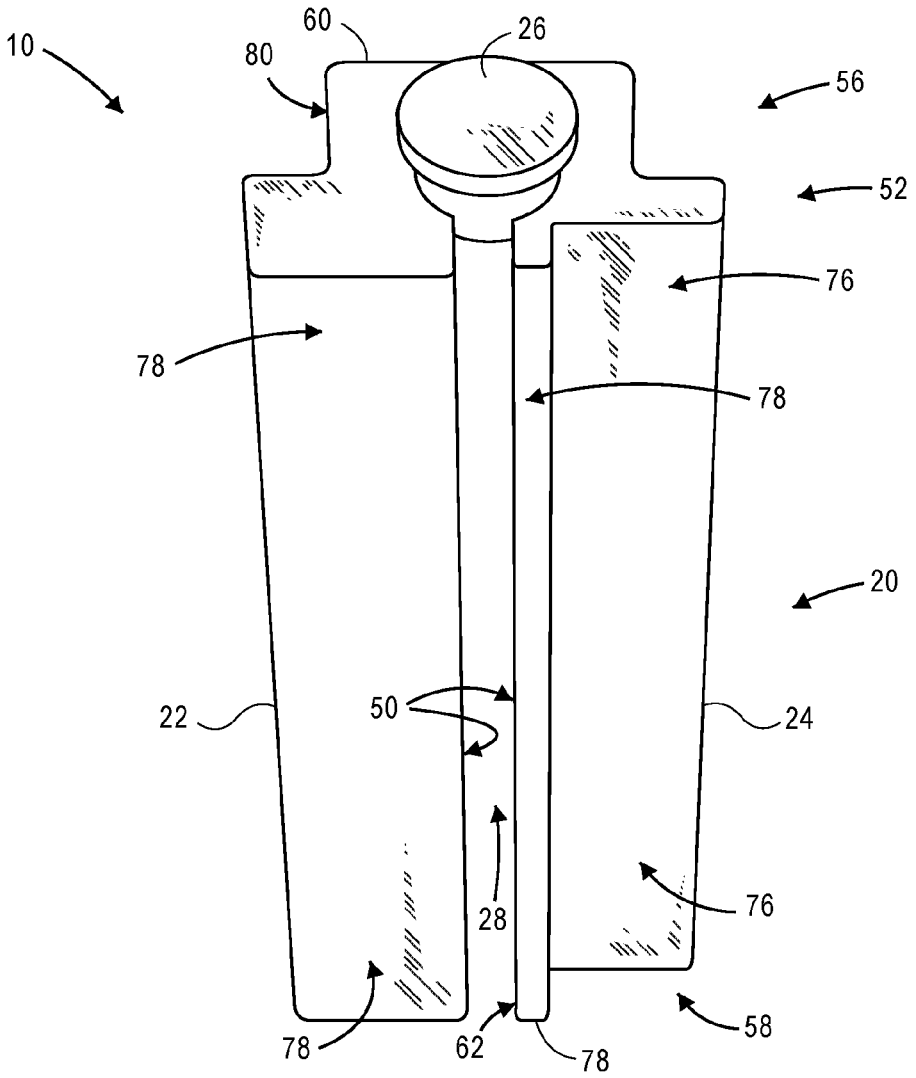
FIG. 2A is a perspective view of a recessed closed hinge configuration of a static hinge disabler.
Figure 2B:
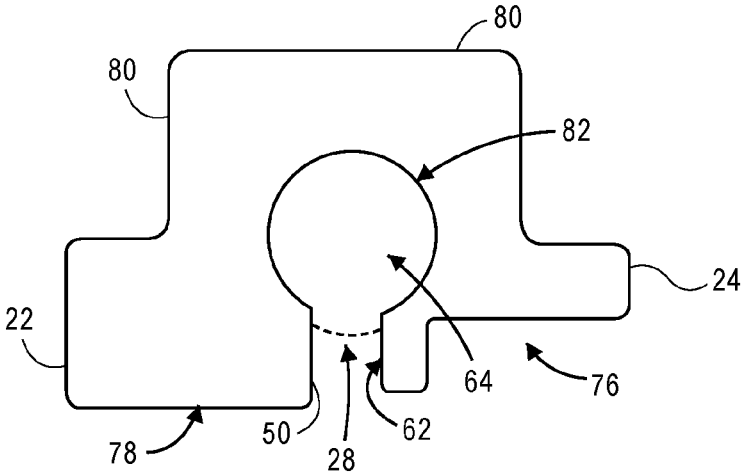
FIG. 2B is a bottom view of the static hinge disabler of FIG. 2A.

Another embodiment of the invention is illustrated in FIG. 2A. The embodiment of FIG. 2A may be referred to as the static hinge disabler 10 being in a recessed closed hinge configuration. The embodiment of FIG. 2A includes the hinge case 60 and a casing recess 76. The first sidewall 22 presents a generally flat wall-interface segment 78. The second sidewall 24 presents the casing recess 76 that is configured to receive a casing 74 of a wall 32. The casing 74 is a protruding section of the wall 32 that is proximate to the door hinge 12. Casings 74 come in a variety of shapes and sizes. The casing recess 76 therefore accommodates, and is generally complementary to the casing 74. This also allow the static hinge disabler 10 of FIG. 2A to perform a similar function to that of FIG. 1A (as discussed above) in preventing operation of the door 14 by manually stopping the door 14 from opening (in addition to the channel 28 preventing the operation of the door hinge 12).

The hinge case 60 of the embodiment of FIG. 2A presents a generally square exterior 80 and a generally rounded interior 82. In other embodiments, the hinge case 60 may present a generally rounded or arcuate exterior in addition to the rounded interior 82 (such as illustrated in FIG. 5A). The rounded interior 82 is generally complementary to an exterior shape presented by the annular segments 46 of the door hinge 12. The rounded interior 82 is also substantially the same size or slightly larger than the annular segments 46 of the door hinge 12. As discussed below, the static hinge disabler 10 may come in a variety of sizes and/or include a variety of spacers to accommodate door hinges 12 of various sizes. It should be appreciated, however, that typically the hinge case 60 does not directly prevent operation of the door hinge 12. Rather it is the relative location of the first sidewall 22 and the second sidewall 24 against the two plates 36 of the door hinge 12 and/or the first sidewall 22 and the second sidewall 24 pressing against the door 14 and the wall 32 that prevent the operation of the door hinge 12.

FIG. 7 illustrates the static hinge disabler 10 of FIG. 2A emplaced over a door hinge 12. As can be seen, the casing recess 76 accommodates the casing 74 around the wall 32. The second sidewall 24 also remains generally parallel and adjacent to the door 14. As discussed above, the user inserts the exposed segment 30 of the door hinge 12 into the channel 28. The channel 28 fully encases the exposed segment 30 of the door hinge 12. The cap 26 keeps the static hinge disabler 10 disposed around the exposed segment 30 of the door hinge 12.

Figure 3A:
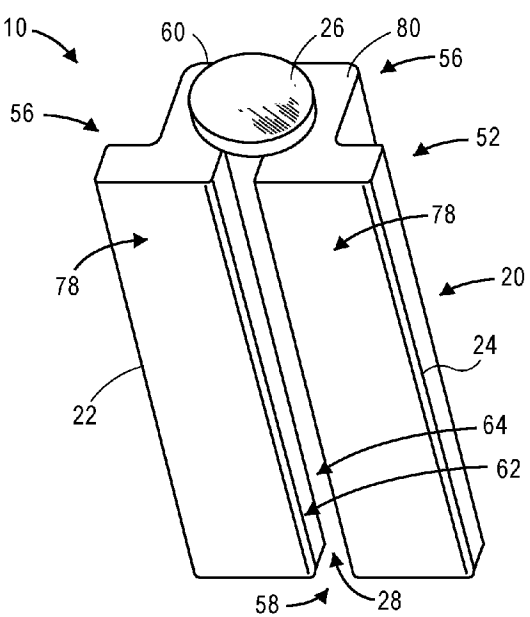
FIG. 3A is a perspective view of a T-shaped closed hinge configuration of a static hinge disabler.

Another embodiment of the invention is illustrated in FIG. 3A. The embodiment of FIG. 3A may be referred to as the static hinge disabler 10 being in a T-shaped closed hinge configuration. The embodiment of the invention illustrated in FIG. 3A is similar to the embodiment illustrated in FIG. 2A, with the major difference being the absence of the casing recess 76 in FIG. 3A. As many doors 14, especially in commercial and industrial applications, do not include a casing 74 (or do not include a casing 74 that protrudes away from the wall 32 relative to the door 14, the casing recess 76 may actually reduce the effectiveness of the static hinge disabler 10 in these applications. Therefore, embodiments of the invention directed to industrial, commercial, or school applications may be similar to FIG. 3A.

Figure 3B:
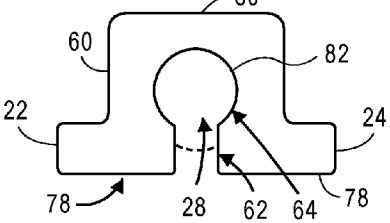
FIG. 3B is a bottom view of the static hinge disabler of FIG. 3A.

The static hinge disabler 10 is generally T-shaped about a horizontal cross-section, as can be seen in FIG. 3B. The first sidewall 22 and the second sidewall 24 are generally flattened so as to snuggly interface against the wall 32 and the door 14. In embodiments of the invention, the first sidewall 22 and the second sidewall 24 are originally manufactured to be of this shape. In other embodiments of the invention, the static hinge disabler 10 of FIG. 3A is formed by adding a recess filler (not illustrated) to take up the casing recess 76. This allows the user to select whether to utilize the casing recess 76 based upon the door hinge 12 onto which the static hinge disabler 10 will be utilized. If the user desires to use the static hinge disabler 10 on a door 14 having a casing 74, the user can remove the recess filler. If the user desires to use the static hinge disabler 10 on a door 14 without a casing 74, the user can insert and secure the recess filler into the casing recess 76 (of an embodiment of the static hinge disabler 10 such as illustrated in FIG. 2A).

Figure 4A:
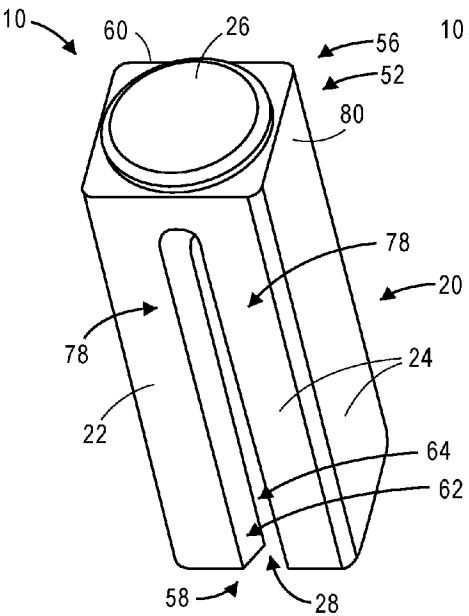
FIG. 4A is a perspective view of a square closed hinge configuration of a static hinge disabler.
Figure 4B:
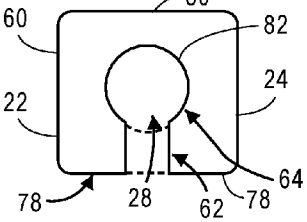
FIG. 4B is a bottom view of the static hinge disabler of FIG. 4A.

Another embodiment of the invention is illustrated in FIG. 4A. The static hinge disabler 10 may present a generally square shape about a horizontal cross section (or as viewed from the bottom as illustrated in FIG. 4B). In these embodiments the first sidewall 22 and the second sidewall 24 are aligned with the square exterior 80 of the hinge case 60. Embodiments such as those illustrated in FIG. 4A may be advantageous because they are relatively small and easy to transport. Embodiments such as illustrated in FIG. 4A may also be adapted to being included in a set of static hinge disablers 10 (as discussed below). This is because the square shape makes them easy to fit next to other similar static hinge disablers 10 in the set.

Figure 5B:
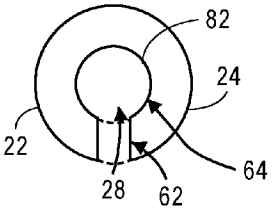
FIG. 5B is a bottom view of the static hinge disabler of FIG. 5A.

Yet another embodiment of the invention is illustrated in FIG. 5A. In this embodiment of the invention the static hinge disabler 10 presents an exterior shape that is substantially cylindrical. In these embodiments, the hinge case 60 is generally circular about a horizontal cross-section (or as viewed from below as illustrated in FIG. 5B). These static hinge disablers 10 may be advantageous for using minimal material to form the components. This makes the static hinge disabler 10 cost effective. These embodiments may also be utilized for home child-proofing as there are not great forces that need to be prevented. Like those illustrated in FIG. 4A, static hinge disablers 10 such as illustrated in FIG. 5A may be suited for inclusion in a set of static hinge disablers 10 (as discussed below).

In other embodiments, the exterior shape may be a rectangular prism, a hexagonal prism, an octagonal prism, an elliptical cylinder, etc. While the interior shape of the channel 28 is complementary to the shape of the exposed segment 30 of the door hinge 12, the exterior shape may be based upon structural or aesthetic considerations. For example, the exterior shape may be an elliptical cylinder with the channel 28 being disposed along the minor axis to provide additional support against the opening forces along the major axis of the ellipse.

As discussed above, the static hinge disabler 10 is emplaced by sliding the static hinge disabler 10 down over the exposed segment 30 of the door hinge 12. The channel 28 of the elongated body 20 is aligned with the two parallel plates 36 of the door hinge 12. The channel 28 of the main body is aligned with the hinging segment 42 and the pin 38 of the door hinge 12. The static hinge disabler 10 slides down the exposed segment 30 of the door hinge 12 until the pin 38 contacts an interior surface of the cap 26. The static hinge disabler 10 thereafter prevents the plates 36 of the door hinge 12 from moving to the open position.

In embodiments of the invention, the static hinge disabler 10 is of a length that is substantially the same as, or slightly longer than, a length of the exposed segment 30 of the door hinge 12. The static hinge disabler 10 is of an inner diameter that is substantially the same as, or slightly larger than, an outer diameter of the exposed segment 30 of the door hinge 12. The channel 28 is of a width that is substantially the same as, or slightly wider than, the width of the two plates 36 of the door hinge 12. However, because there is no standardized length and diameter of a door hinge 12, the static hinge disabler 10 may come in a variety of sizes or be custom manufactured for specific door hinges 12.

In embodiments of the invention, the static hinge disabler 10 is formed of a metal, such as steel or aluminum. The metal provides significant structural strength to withstand forces placed on it. In other embodiments, the static hinge disabler 10 is formed of a hardened polymer or plastic. Static hinge disablers 10 formed of metal may be more suitable for active shooter situations and room defense applications (discussed above) in which the maximum protection is desired. Static hinge disablers 10 formed of plastics or other polymers may be more suitable for home child-proofing in which lightweight and convenience is more important than maximum protection. If the static hinge disabler 10 is utilized only to prevent a child from leaving a room (as opposed to keeping a malfeasant out of a room) significant strength is not as important of a consideration. However, in some embodiments, polymer static hinge disablers 10 may be utilized to prevent the ingress of a malfeasant and metal static hinge disablers 10 may be utilized to prevent the egress of a child.

In embodiments of the invention, as discussed above, the static hinge disabler 10 is manufactured, machined, cast, or otherwise formed of a single, unitary, monolithic structure. In other embodiments, the static hinge disabler 10 is formed of a monolithic elongated body 20 and a monolithic cap 26. It should also be appreciated that "unitary" as used herein refers, in some embodiments, to the finished static hinge disabler 10 having no moving parts or components.

A few exemplary embodiments of the static hinge disabler 10 will now be briefly discussed. In some embodiments, the static hinge disabler 10 is provided in a set of various sizes. The set may come in a carrying case that is adapted to include a static hinge disabler 10 that is adapted to fit to most or all door hinges 12. This allows a user to lock most doors 14 at any time, without having to install a new lock on a door 14 for additional protection. For example, the set may be utilized to install onto a door 14 in a hotel room. Because the user does not know the size and shape of the door hinge 12 that will be located on the door 14 to their hotel room, the user brings the set of static hinge disablers 10 along on their trip. In this way, the user will likely have a static hinge disabler 10 of the appropriate size to emplace on the door hinge 12 of the door 14 to their hotel room.

In some embodiments, the static hinge disabler 10 further comprises at least one spacer (not illustrated) to fit door hinges 12 of various sizes. In these embodiments, the static hinge disabler 10 is relatively large to fit relatively large door hinges 12. The spacers fit within the static hinge disabler 10 to adapt the static hinge disabler 10 to fit onto successively smaller door hinges 12. The spacers may include a cylindrical spacer wall and a spacer cap (to prevent the spacer from falling out the bottom of the static hinge disabler 10). In some embodiments, the spacer presents a shape substantially similar too, but thinner than, the static hinge disabler 10 (and/or the channel 28). Each spacer reduces the inner diameter/width of the channel 28 and/or the width of the channel 28. So, for example, the static hinge disabler 10 may include 3 spacers, each reducing the inner diameter and the width of the channel 28 by approximately 20%. In some embodiments of the invention, the spacers are formed of a metal. In other embodiments, the spacers are formed of a hardened polymer. The spacers may be stored, when not in use, in a carrying case that accompanies the static hinge disabler 10, or may be secured to the hinge case 60 (or other component) of the elongated body 20.

In some embodiments, not illustrated, the static hinge disabler 10 is secured to the doorframe 34 and/or the door hinge 12. In these embodiments, the static hinge disabler 10 is permanently or semi-permanently attached in the proximity in which it will be used. Attachment may be by a lanyard (not illustrated) such as a chain, rope, etc. A first end of the lanyard may be secured to the cap 26 of the static hinge disabler 10. A second end of the lanyard may be secured to the pin 38, the lowest annular segment 46, one of the plates 36, etc. The lanyard provides enough slack to easily allow for the installation of the static hinge disabler 10 over the associated door hinge 12. The above embodiments may be beneficial in schools, hotels, and the like to ensure that a static hinge disabler 10 is available for use in an emergency.

In some embodiments, the static hinge disabler 10 further comprises a retention strap (not illustrated). The retention strap may be disposed at or near the open end of the elongated body 20. The retention strap is configured to be emplaced over a bottom end of the exposed segment 30 of the door hinge 12 while the static hinge disabler 10 is disposed on the door hinge 12. The retention strap prevents the static hinge disabler 10 from being easily or accidently removed from the door hinge 12. For example, if a malfeasant is attempting to defeat the static hinge disabler 10, the malfeasant may fit a thin wire or other device through the partially opened door 14. The malfeasant may then push the static hinge disabler 10 upward in attempt to get the static hinge disabler 10 to fall off. The retention strap prevents the malfeasant from accomplishing this.

In some embodiments, a bottom cap (not illustrated) is selectively placed onto the open end of the elongated body 20 and secured thereto to prevent the static hinge disabler 10 from being removed from the door hinge 12 (as discussed above). For example, the bottom cap may include a threaded segment that is complementary to a threaded segment of the open end of the elongated body 20. The user, upon installing the static hinge disabler 10, will then screw the bottom cap into the threaded segment of the elongated body 20. This will prevent a malfeasant from removing the static hinge disabler 10 from the opposite side of the door 14.

The bottom cap may also allow the static hinge disabler 10 to be installed inversely (e.g., upside-down), such that the user would push the open side 58 of the elongated body 20 upward onto the door hinge 12 from below and then twist the bottom cap onto the top side open side 58 that is atop the door hinge 12. This may be a more convenient installation method for some users.

In some embodiments, both the bottom cap and the cap 26 are selectively removable, such as via a threaded segment. The static hinge disabler 10 of these embodiments may therefore be symmetrical and allow the user to selectively place the cap 26 and/or the bottom cap onto the static hinge disabler 10 as desired. This may make the static hinge disabler 10 more universally compatible. For example, the static hinge disabler 10 of FIG. 2A may be used with the bottom cap and the cap 26 selectively removable. This allows the static hinge disabler 10 to be utilized on a door 14 in which the frame is on the right and a door 14 in which the frame is on the left. This is because the casing recess 76 can be emplaced on the right side or the left side depending on the orientation of the static hinge disabler 10 relative to the door hinge 12.

In some embodiments, the door hinge 12 is manufactured and originally sold to include the static hinge disabler 10. This embodiment provides the advantage of ensuring a secure and optimized fit of the static hinge disabler 10 to the corresponding door hinge 12. As an example, a door hinge manufacturer may produce solitary door hinges 12 and coupled door hinges 12 with attached unitary door hinges 12. The door hinge manufacturer may then suggest that customers purchase and install a single coupled door hinge 12 as the top door hinge 12 on a given door 14, and that customers purchase and install two or three (depending on the door 14) solitary door hinges 12. This allows the customer to achieve an additional door lock without extra installation and wall damage.

In some embodiments, a door hinge system is sold as a unit and configured to be installed on a door 14 at a wall 32. the door hinge system includes one or more hinges and a static hinge disables configured to be utilized in conjunction with that hinge. For example, the door hinge system may include two hinges and the static hinge disabler 10. A first hinge and a second hinge are each configured to be installed between the door 14 and the wall 32. The first hinge and the second hinge are configured to support the door 14 and allow the door 14 to selectively open and close. The static hinge disabler 10, as discussed above, is configured to be selectively placed over the first hinge while the door 14 is closed to prevent the first hinge from operating and allowing the door 14 to open. The static hinge disabler 10 may additionally be configured to fit over the second hinge. In some embodiments, the door hinge set may further include a second static hinge disabler 10 configured to be installed over the second hinge. This may provide additional protection and prevention of the operation of the door hinge 12.

While the operation of the static hinge disabler 10 has been discussed throughout, a method of using embodiments of the invention will now be discussed for clarity. A method of preventing the operation of a door hinge 12, the method comprises the following steps: aligning an exposed segment 30 of the door hinge 12 with a channel 28 of a static hinge disabler 10, wherein the channel 28 is disposed between a first sidewall 22 of the static hinge disabler 10 and a second sidewall 24 of the static hinge disabler 10; sliding the exposed segment 30 of the door hinge 12 into the channel 28 such that the exposed segment 30 of the door hinge 12 is disposed between the first sidewall 22 and the second sidewall 24; and resting a top end of the exposed segment 30 of the door hinge 12 against a cap 26 of the static hinge disabler 10 such that the exposed segment 30 remains within said channel 28, wherein the relative location of the first sidewall 22 and the second sidewall 24 prevent the exposed segment 30 of the door hinge 12 from operating.

While it has been discussed throughout, it should be noted that in embodiments of the invention, the static hinge disabler 10 is separate and distinct from the door hinge 12, such that it may be selectively removed. In these embodiments, the static hinge disabler 10 is not permanently installed, fixed, or attached to the door hinge 12. This provides the versatility to add the additional locking protection to many different doors 14.

Although embodiments of the invention have been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A static hinge disabler for preventing the operation of a door hinge, comprising:
- a first sidewall;
- a second sidewall substantially parallel to the first sidewall;
- a channel disposed between the first sidewall and the second sidewall,
- wherein the channel is configured to receive at least a portion of the door hinge therein,
- wherein the first sidewall and the second sidewall are statically connected such that the channel does not change shape,
- wherein the first sidewall and the second sidewall prevent the door hinge from operating while the door hinge is disposed within the channel; and
- a cap configured to keep the first sidewall and the second sidewall in contact with the door hinge,
- wherein the channel presents a cap side that is proximate to the cap and an open side that is opposite the cap side,
- wherein the channel is configured to receive the hinge from the open side,
- wherein the first sidewall, the second sidewall, and the cap form a generally flattened plate when viewed from a cap side.

2. The static hinge disabler of claim 1, wherein the first sidewall, the second sidewall, and the cap are monolithic.

3. The static hinge disabler of claim 1,
- wherein the first sidewall is configured to be secured proximate to a first plate of the hinge,
- wherein the second sidewall is configured to be secured proximate to a second plate of the hinge.

4. The static hinge disabler of claim 1, wherein the cap is configured to rest against a top portion of the hinge while the hinge is disposed within the channel.

5. The static hinge disabler of claim 1, wherein the static hinge disabler is configured to be selectively placed on the hinge by sliding the hinge into the channel such that no permanent installation is required to prevent operation of the door hinge.

6. The static hinge disabler of claim 1,
- wherein the first sidewall presents a first beveled edge, wherein the second sidewall presents a second beveled edge,
- wherein the first beveled edge and the second beveled edge present a shape that is complementary to a shape presented by the door hinge.

7. The static hinge disabler of claim 6,
- wherein the cap presents a third beveled edge,
- wherein the first beveled edge, the second beveled edge, and the third beveled edge are continuous.

8. The static hinge disabler of claim 1, further comprising:
- a hinge case secured to the first sidewall and the second sidewall,
- wherein the hinge case is configured to surround the hinge that is disposed within the channel.

9. The static hinge disabler of claim 8, wherein the hinge case, the first sidewall, and the second sidewall are all monolithic.

10. The static hinge disabler of claim 9, wherein the hinge case, the first sidewall, and the second sidewall are permanently secured so as to prevent relative movement between the hinge case, the first sidewall, and the second sidewall.

11. The static hinge disabler of claim 8, wherein the hinge case is generally square about a horizontal cross-section.

12. The static hinge disabler of claim 8, wherein the hinge case is generally circular about a horizontal cross-section.

13. The static hinge disabler of claim 1, wherein the first sidewall presents a generally flat wall-interface segment, wherein the second sidewall presents a generally flat door-interface segment.

14. The static hinge disabler of claim 13, wherein the first sidewall further presents a casing recess configured to receive a casing of a wall.

15. The static hinge disabler of claim 13, wherein the static hinge disabler is generally T-shaped about a horizontal cross-section.

16. A method of preventing the operation of a door hinge, the method comprising the following steps:

aligning an exposed segment of the door hinge with a channel of a static hinge disabler, wherein the channel is disposed between a first sidewall of the static hinge disabler and a second sidewall of the static hinge disabler, wherein the first sidewall presents a first beveled edge, wherein the second sidewall presents a second beveled edge, wherein the first beveled edge and the second beveled edge present a shape that is complementary to a shape presented by the door hinge;

sliding the exposed segment of the door hinge into the channel such that the exposed segment of the door hinge is disposed between the first sidewall and the second sidewall; and resting a top end of the exposed segment of the door hinge against a cap of the static hinge disabler such that the exposed segment remains within said channel, wherein the relative location of the first sidewall and the second sidewall prevent the exposed portion of the door hinge from operating.

17. The method of claim 16, wherein the static hinge disabler is separate and distinct from the door hinge, such that it may be selectively removed.

18. The method of claim 16, wherein the static hinge disabler is monolithic such that the static hinge disabler presents an unchangeable shape.

19. A door hinge system configured to be installed on a door at a wall, the door hinge system comprising:

a first hinge configured to be installed between the door and the wall;

a second hinge configured to be installed between the door and the wall, wherein the first hinge and the second hinge are configured to support the door and allow the door to selectively open and close; and a static hinge disabler configured to be selectively placed over the first hinge while the door is closed to prevent the first hinge from operating and allowing the door to open, said static hinge disabler including— a first sidewall;

a second sidewall substantially parallel to the first sidewall;

a channel disposed between the first sidewall and the second sidewall, wherein the channel is configured to receive at least a portion of the first hinge therein, wherein the first sidewall and the second sidewall are statically connected such that the channel does not change shape, wherein the channel presents a shape that is complementary to an exposed segment of the first hinge; and a cap configured to keep the first sidewall and the second sidewall in contact with the first hinge, wherein the channel presents a cap side that is proximate to the cap and an open side that is opposite the cap side, wherein the channel is configured to receive the first hinge from the open side wherein the first sidewall, the second sidewall, and the cap form a generally flattened plate when viewed from a cap side.

* * * * *